United States Patent [19]

Daniel

[11] 3,958,639

[45] May 25, 1976

[54] METHOD OF DRILLING AN OIL WELL TO RECOVER CASINGS

[76] Inventor: Arlie H. Daniel, 2630 Belle Chasse, Gretna, La. 70053

[22] Filed: June 28, 1974

[21] Appl. No.: 484,136

[52] U.S. Cl. ..... 166/294; 166/285; 175/57

[51] Int. Cl.[2] ..... E21B 33/13

[58] Field of Search ..... 166/285, 288, 301, 293, 166/294, 315; 175/72, 171, 57, 65

[56] References Cited

UNITED STATES PATENTS

| | | | |
|---|---|---|---|
| 978,359 | 12/1910 | Cooper | 166/288 |
| 1,548,012 | 7/1925 | Dunn | 166/285 |
| 2,064,936 | 12/1936 | McQuiston | 175/72 |
| 2,259,564 | 10/1941 | Holland | 166/301 |
| 2,363,269 | 11/1944 | Schlumberger | 166/288 |
| 2,716,018 | 8/1955 | Williams | 175/171 |
| 3,110,346 | 11/1963 | Spurlock et al. | 166/285 |
| 3,406,756 | 10/1968 | Carter et al. | 166/285 |
| 3,713,488 | 1/1973 | Ellenburg | 175/72 |

FOREIGN PATENTS OR APPLICATIONS

| | | | |
|---|---|---|---|
| 728,197 | 4/1955 | United Kingdom | 166/285 |

OTHER PUBLICATIONS

Dowell Advertisement, "Oil & Gas Journal," 7/22/74.

*Primary Examiner*—John E. Murtagh
*Assistant Examiner*—Jack E. Ebel
*Attorney, Agent, or Firm*—Wilkinson, Mawhinney & Theibault

[57] ABSTRACT

The present disclosure is directed to a method of drilling an oil well so that the large diameter casing initially employed can be salvaged and reused which is attainable by effecting a temporary seal between the bore hole and casing so that a dual function is attained, firstly the seal forces the mud return up to the surface inside the casing and secondly the area between the bore hole and casing is closed to cuttings cement and other matter which may fall into a bore hole and cause the casing to become secured to the walls of the bore hole and prohibit the withdrawal of the casing from the bore hole. When it is desired to remove the casing the temporary seal is broken and the casing raised axially of the bore hole.

2 Claims, 2 Drawing Figures

METHOD OF DRILLING AN OIL WELL TO RECOVER CASINGS

An object of the present invention is the prevention of the ultimate abandonment of thousands of feet of large diameter casing employed in the drilling of oil wells, particularly if the well results in a dry hole and is sealed off and abandoned.

A further object of the present invention is the taking of initial procedure at the commencement of drilling of the well so that the casing may be ultimately recovered rather than end up secured so firmly in the bore hole as to resist its being axially withdrawn by any commercially expedient procedures.

Another object of the present invention is establishment of a temporary seal between the outside of the casing and the bore hole so that not only will the casing be retrievable but the mud returns will be forced to the surface within the casing to the pits for analysis and the drilling fluids will not cement or cause the casing to tenaciously adhere to the walls of the bore hole, when it is time to remove the casing the seal is broken and the casing is clear of the wall of the bore hole for removal therefrom.

With the foregoing and other objects in view the invention will be more fully described hereinafter and more particularly pointed out in the appended claims.

In the drawings in which like parts are denoted by reference characters throughout the several views.

Figure 1:
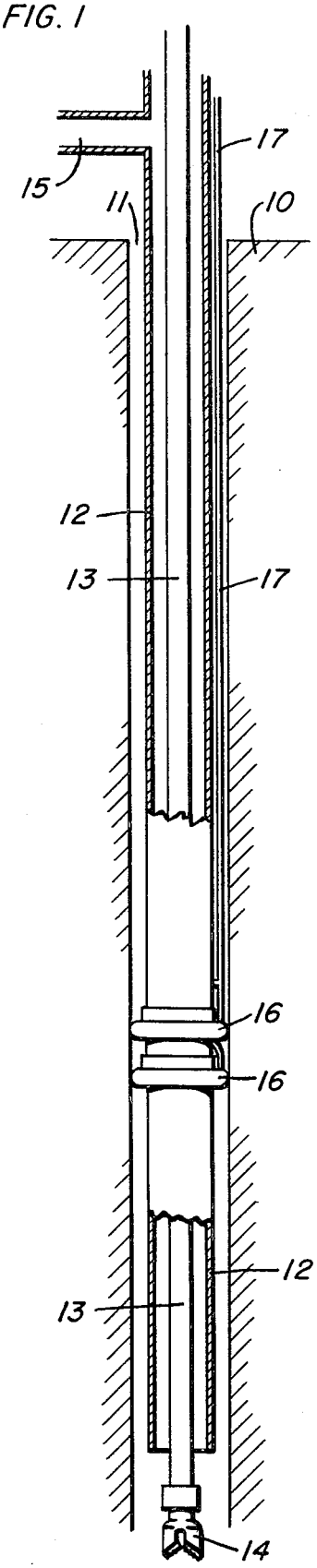
FIG. 1 is a schematic of a vertical section of a bore hole having a casing, drill string within the casing and the temporary releasable seal of the present method installed about the casing.
Figure 2:
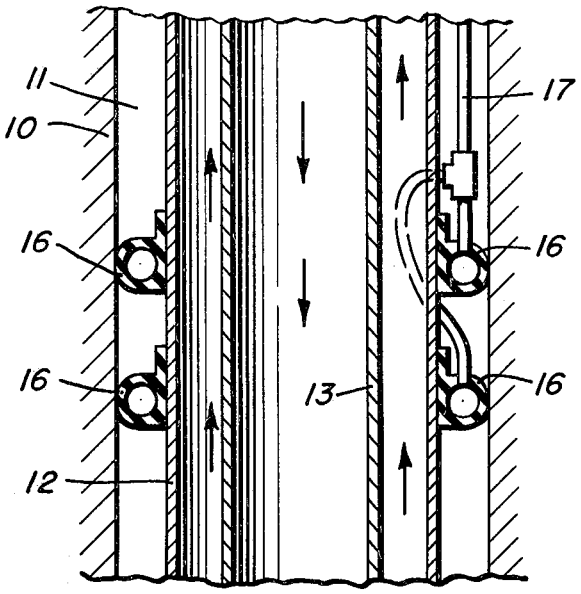
FIG. 2 is a vertical section taken through the bore hole casing and drill string at the point of application of the temporary releasable seal, having parts broken away and parts shown in section taken at a magnified scale over that of FIG. 1.

Referring now to the drawings, 10 designates the earth into which has been bored a bore hole 11 into which has been inserted a surface or starter casing 12, the external diameter of which is less than the internal diameter of the bore hole 11. Passing through the casing 12 in a conventional manner is a drill string 13 having a cutting head 14. Above the earth's surface the casing has a discharge line 15 which goes to the mud pits so that the drilling fluid whether it be mud, water, air or whatever which is introduced to the cutting head 14 through the drill string 13 acts to bring the material cut from the earth by the drill head to the surface through the inside of the casing for analysis.

One or more releasable sealing means 16 may be installed between the surface starter casing 12 and the bore hole 11. This temporary seal may be of rubber, plastic or an inflatable material to be filled with air, gas or liquid to bring about a seal of the area between the bore 11 and the casing as by fluid lines 17 which run to the surface where a source of pressurized fluid is introduced to cause expansion of the inflatable sealing means as shown in the drawings.

Surface starter casing sections run from 30 to 45 feet in length and this large initial casing being approximately 200 feet in length is of the order of sixteen inches in diameter or smaller and recovery of this amount of casing becomes very important because of its cost and the fact that it is reusable whether it is threadly joined by couplings or welded.

A plurality of the inflatable seals 16 may be placed along the casing 12 as necessary to assure against drilling fluid coming up the outside of the casing or cuttings eroding from the wall of the bore hole.

When the decision to remove the surface starter casing 12 is made the seal 16 is broken, the casing cut and raised axially of the bore hole and either uncoupled or cut at desired lengths.

The sealing means performs two functions, one to assure that the returns from the drilling come to the surface inside the casing and second that the casing has been kept from appreciable contact with the bore hole which would increase its resistance to being axially pulled from the bore hole.

Another form of seal which I employ is introduced between the casing and bore hole is a plastic seal which is introduced into the bore hole in a muddy water consistency and which sets up to a plastic having a coefficient of friction which will permit sliding of the casing upwardly along the axis of the bore hole.

An example of the plastic seal is a material supplied by Petroleum Associates of Lafayette Inc. of Lafayette, La. and which is designated as PAL-MIX 110R which is a complex mixture of synthetic and organic polymers with auxillary chemicals. It is delivered as a dry white powder and may be mixed in fresh water, salt water or oil emulsions. The mix is initially just a slightly viscous liquid — same viscosity as the liquid with which it is mixed. It changes from a liquid to a tough plastic. For up to three hours it can be pumped like muddy water and at the desired pumping time, it changes to a plastic. More detailed information on PAL-MIX 110R is given in a Petroleum Associates of Lafayette bulletin entitled "The Modern, Engineered Approach to Stopping Lost Circulation" Revision No. 3 (effective Apr. 1, 1973).

What I claim is:

1. The method of drilling an oil well to ultimately recover a surface casing and to assure of the return flow of drilling fluid back to surface mud pits and to prohibit the outer walls of the surface casing from being permanently sealed to the wall of a bore hole comprising, drilling a bore hole, inserting the surface casing of lesser external diameter than the diameter of the bore hole, releasably effecting a temporary seal between the outside of the surface casing and the bore hole to compel return of drilling fluids with the casing up to the pits, overcoming the temporary seal by axially withdrawing the casing from the bore hole.

2. The method of drilling an oil well as claimed in claim 1 wherein the temporary seal between the outside of the casing and the bore hole is attained by pumping a plastic containing solution between the casing and bore hole which sets up in the bore hole to effect a seal which may be subsequently broken by mere axial extraction of the surface casing from the bore hole.

* * * * *